United States Patent [19]

Giese et al.

[11] 4,316,332

[45] Feb. 23, 1982

[54] ATHLETIC SHOE CONSTRUCTION HAVING SHOCK ABSORBING ELEMENTS

[75] Inventors: Erik O. Giese, Key Biscayne, Fla.; Alexander L. Gross, Aspen, Colo.

[73] Assignee: Comfort Products, Inc., Aspen, Colo.

[21] Appl. No.: 204,860

[22] Filed: Nov. 7, 1980

Related U.S. Application Data

[63] Continuation of Ser. No. 32,354, Apr. 23, 1979, abandoned.

[51] Int. Cl.[3] ..... A43B 13/18; A43B 13/12; A43B 21/32; A43B 5/00

[52] U.S. Cl. ..... 36/28; 36/30 R; 36/37; 36/114

[58] Field of Search ..... 36/28, 30 R, 30 A, 33 R, 36/37, 114, 129

[56] References Cited

U.S. PATENT DOCUMENTS

| | | | |
|---|---|---|---|
| 532,429 | 1/1895 | Rogers | 36/28 |
| 699,549 | 5/1902 | McIntyre . | |
| 925,354 | 6/1909 | Lambert . | |
| 1,362,229 | 12/1920 | Colburn . | |
| 1,559,532 | 10/1925 | Smith | 36/28 |
| 1,841,942 | 4/1929 | Fenton . | |
| 1,976,389 | 10/1934 | Everston | 36/30 A |
| 2,055,072 | 9/1936 | Everston | 36/28 X |
| 2,132,882 | 10/1938 | Rigandi | 36/30 A |
| 2,374,487 | 4/1945 | Jayne | 36/32 R |
| 2,502,774 | 4/1950 | Alianiello | 36/28 |
| 3,341,952 | 7/1965 | Dassler . | |
| 3,822,490 | 7/1974 | Murawski . | |
| 3,834,046 | 9/1974 | Fowler | 36/28 |
| 4,043,058 | 8/1977 | Hollister . | |
| 4,067,123 | 1/1978 | Minihane | 36/32 R |
| 4,098,011 | 7/1978 | Bowerman et al. | 36/32 R |
| 4,102,061 | 7/1978 | Saaristo | 36/28 |
| 4,128,950 | 12/1978 | Bowerman et al. | 36/28 X |

FOREIGN PATENT DOCUMENTS

| | | | |
|---|---|---|---|
| 2318521 | 10/1974 | Fed. Rep. of Germany | 36/28 |
| 2336314 | 2/1975 | Fed. Rep. of Germany | 36/37 |
| 246346 | 2/1928 | Italy . | |
| 517532 | 2/1940 | United Kingdom | 36/37 |
| 1444091 | 7/1976 | United Kingdom | 36/28 |

*Primary Examiner*—James Kee Chi
*Attorney, Agent, or Firm*—Pennie & Edmonds

[57] ABSTRACT

An athletic shoe construction having shock absorbing elements in the heel and forefoot areas of the sole portion of the shoe which elements are surrounded on their sides by comparatively hard rim portions of a sole shell or mid-sole.

2 Claims, 4 Drawing Figures

FIG. 1
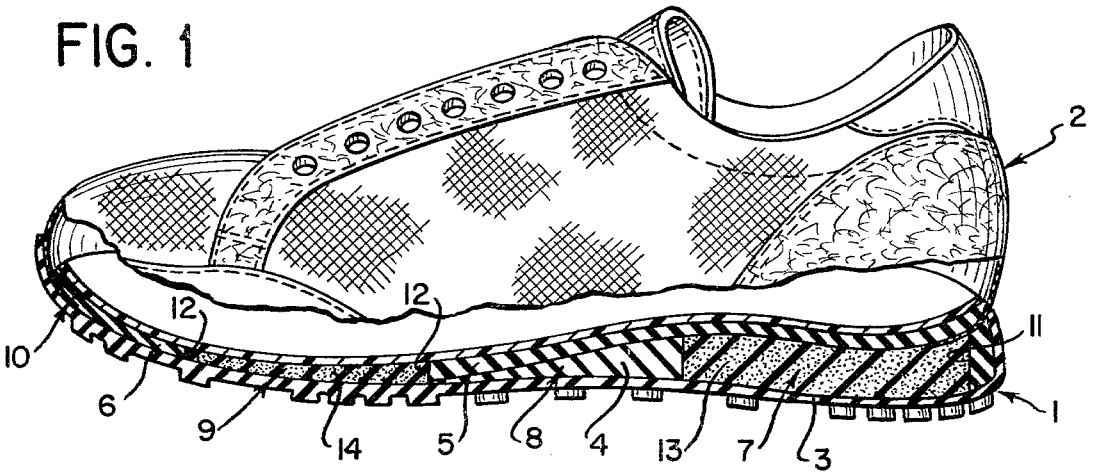
FIG. 2
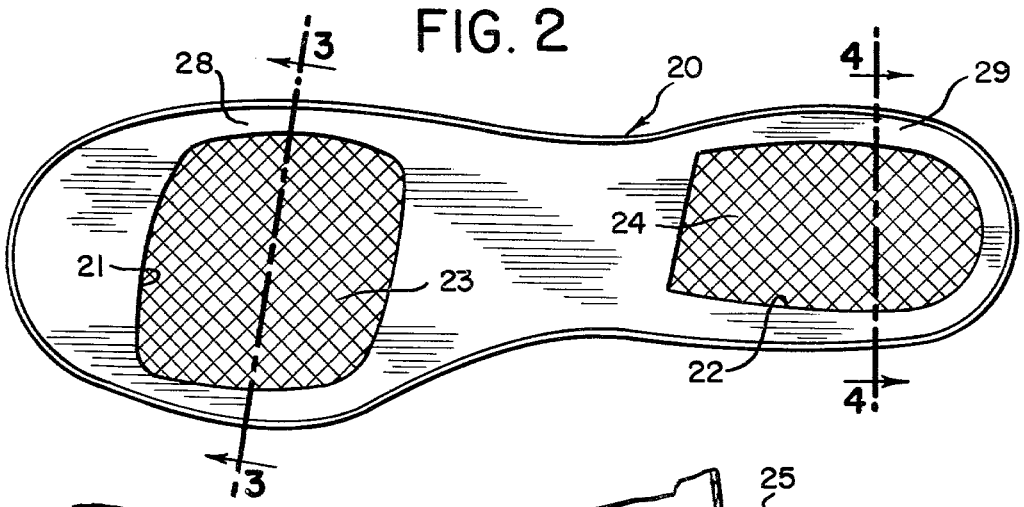
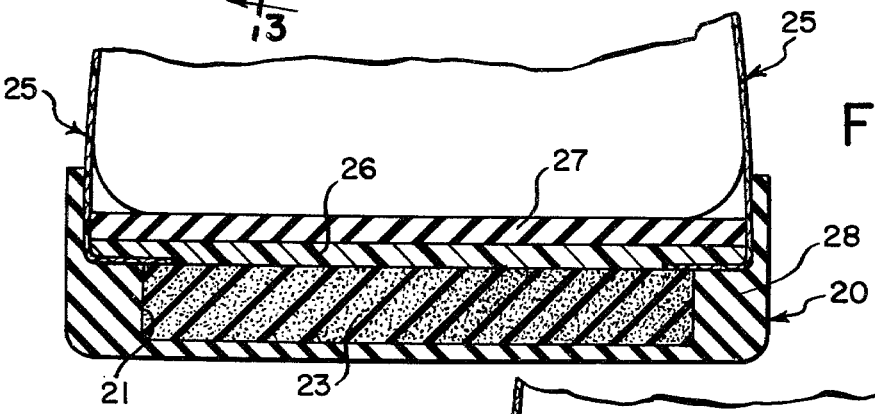
FIG. 3
FIG. 4
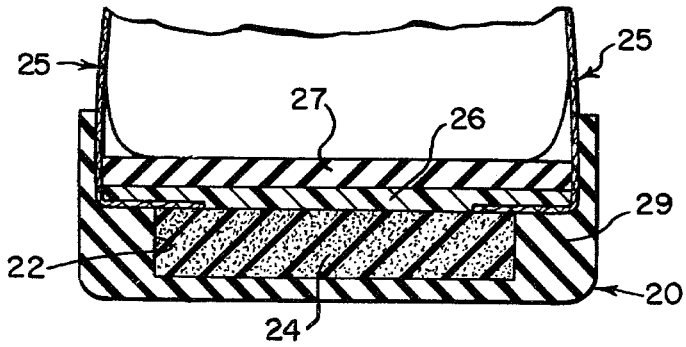

ATHLETIC SHOE CONSTRUCTION HAVING SHOCK ABSORBING ELEMENTS

This is a continuation of application Ser. No. 032,354, filed Apr. 23, 1979, now abandoned.

TECHNICAL FIELD

The invention relates to an athletic shoe construction having shock absorbing elements in the heel and forefoot areas of the sole portion of the shoe which elements are surrounded on their sides by comparatively hard rim portions of a sole shell or mid-sole.

CROSS-REFERENCE TO OTHER APPLICATIONS

This application relates to similar subject matter disclosed in co-pending application Ser. No. 221,068 filed Dec. 29, 1980 which is a continuation of application Ser. No. 027,313 filed Apr. 5, 1979, now abandoned, and assigned to the same assignee as the instant application.

BACKGROUND ART

A problem existing with conventional athletic shoes is that their design fails to take into account that different shock loads are applied to different areas of the sole of the foot of a participant during various forms of athletic endeavors, as for example during running, playing basketball, tennis, etc. It is known that in most athletic endeavors the heel and forefoot areas of the foot receive more intense shock loads than other areas of the foot including the arch and toe areas. For example, in running shoes, it is known that the runner's foot usually contacts the ground by engaging the heel first, then with the side of the foot and then with the forefoot such that the greater shock loads are absorbed first by the heel area of the sole portion of the shoe and last by the forefoot area. In other athletic shoe constructions, for example, in basketball shoes, even more intense shock loads are applied at the heel area as a result from landing on the foot after jumping. Athletic shoe constructions to date however have not included any separate shock absorbing elements in those areas of the sole portions of the shoes subject to greater shock loads where the shock absorbing properties of the elements at those areas differ from any shock absorbing properties of the remaining areas of the sole portions.

Also in the case of basketball and tennis shoes as compared with running shoes, strong side loads are imparted to the sole portion due to side thrust being applied by the foot of the participant resulting from quick changes of direction. The result is that the side of the sole portion on the outside of a turn will often deform to a great extent and fail to give necessary support to the foot.

It is therefore an object of our invention to provide for an athletic shoe construction which will have shock absorbing elements applied to those areas of the sole portion receiving the more intense shock loads, namely the heel area and forefoot area, and at the same time to provide a sole construction which will be able to accommodate side thrust as may occur from a sudden change in direction.

DISCLOSURE OF INVENTION

An athletic shoe constructed according to the invention comprises a sole portion connected to a conventional upper where the sole portion includes heel, arch, forefoot and toe areas. The heel area includes a first shock absorbing element and the forefoot area includes a second shock absorbing element with both shock absorbing elements being surrounded on their peripheries by a comparatively stiff rim or part of the sole portion. In one form of the invention, the sole portion comprises an assembly of an outer sole, a heel wedge, and a mid-sole, all joined together by adhesive or other means. The heel wedge in this form of the invention has a cut out therein into which is inserted a first shock absorbing element and the mid-sole has a cut out therein in the forefoot area into which a second shock absorbing element is inserted. By utilizing cut outs in the heel wedge and in the mid-sole sufficient material remains at the periphery of the shock absorbing elements to stabilize and provide support to the foot when the sole portion is subjected to side thrust loads as occurs from quick turns or stops. A further form of the invention is adopted for sole portion constructions in which the outer sole comprises a molded sole shell of the type as usually found in basketball shoes. The sole shell in this type of shoe includes molded depressions or recesses in the heel and forefoot areas into which shock absorbing elements may be inserted. The shock absorbing elements and inner part of the sole shell may then be overlaid by a lasting material. As in the case with the prior mentioned embodiment, sufficient support is provided by the molded sole portion at the periphery of the recesses to support the foot during applications of side loads without any excess deformation of the sole portion, while at the same time the shock absorbing elements cushion shock loads at those areas of the sole portion where shock loads are greatest, namely the heel and forefoot areas.

BRIEF DESCRIPTION OF DRAWING

FIG. 1 is a sectional view of a portion of an athletic shoe constructed according to the invention wherein the sole portion comprises an assembly of an outer sole, heel wedge, and a mid-sole;

FIG. 2 is a plan view of a sole shell utilized in a second embodiment of the invention;

FIG. 3 is a sectional view of an athletic shoe construction utilizing the sole shell of FIG. 2 taken at the forefoot area; and, FIG. 4 is a sectional view of the shoe construction of FIG. 3 taken at the heel area.

BEST MODE FOR CARRYING OUT THE INVENTION

Referring to FIG. 1 there is illustrated an athletic shoe designed for running having a sole portion 1 joined to a conventional upper 2. The sole portion comprises an assembly of an outer sole 3, a heel wedge 4 and a mid-sole 5 which are joined together by an adhesive or other means. A lasting material 6 overlies the sole portion 1. The sole portion includes a heel area 7, an arch area 8, a forefoot area 9 and a toe area 10. The heel wedge 4 has a cut out 11 contained in the heel area and the mid-sole 5 has a cut out 12 contained in the forefoot area. A first shock absorbing insert 13 is positioned in the cut out 11 in the heel area and a second shock absorbing insert 14 is positioned in the cut out 12 in the forefoot area.

Shock absorbing elements 13 and 14 are softer than the materials comprising the heel wedge 4 and the mid-sole 5 and preferably comprise a foam-like rubber material. By positioning these elements in the heel and forefoot areas, they are contained in that part of the sole portion which is subjected to greater shock loads, namely the heel and forefoot areas. By utilizing cut outs, sufficient material may be left in the heel wedge and mid-sole to provide a support area or rim which extends around the peripheries of the elements and particularly at the sides of the sole portion. Since the material of the support area is harder than that of the shock absorbing elements, it will serve to support the inner and outer edges of the foot and prevent excessive deformation of the sole portion when side thrusts are applied to the sole portion as may occur with a quick change of direction.

Referring to FIGS. 2, 3 and 4, there is illustrated a further embodiment of an athletic shoe construction utilizing a molded sole shell 20. The sole shell is molded to include a recess 21 in the forefoot area and a recess 22 in the heel area. A shock absorbing element 23 is inserted into the recess 21 and a shock absorbing element 24 into the recess 22. Both elements 23 and 24 are similar in compositon to the elements 13 and 14 of the shoe of FIG. 1. An upper 25 is joined to the sole shell by adhesive means and a lasting material 26 may overlay the sole shell. A conventional insole 27 overlaps the lasting material.

The part of the sole shell along the edges of the shoe, namely molded sides 28 and 29 provide stability and support to the foot when side thrusts are imparted to the sole as may occur from quick turns and to prevent the sole portion from deforming at its edges.

We claim:

1. In an athletic shoe construction having a sole portion connected to an upper portion and where said sole portion includes a heel area, an arch area, a forefoot area and a toe area; the improvement comprising in that said sole portion includes an outer sole, a heel wedge having a cutout therein and a mid-sole overlying said forefoot area and having a cutout therein; in that the cutout in the heel wedge has a first shock absorbing element therein, in that the cutout in the mid-sole has a second shock absorbing element therein, in that the remainder of said sole portion including said toe and arch areas comprises a harder material than said first and second shock absorbing elements, and in that the outer peripheries of both said elements are surrounded by said harder material to provide stability and support to a foot when side thrust loads are imparted to the shoe.

2. In an athletic shoe construction having a molded sole shell connected to an upper portion where said molded shell includes a heel area, in arch area, a forefoot area and a toe area; the improvement comprising in that said molded sole shell includes a recess in the forefoot area and a recess in the heel area with the portions of the sole shell between the side edges thereof and the recesses forming support surfaces to provide stability and support to the foot when side thrust loads are imparted to the shoe, in that a first shock absorbing element comprising a softer material than said molded sole shell is included in the recess in the heel area and that a second shock absorbing element comprising a softer material than said molded sole shell is included in the recess in the forefoot area, and in that the portion of the molded sole shell extending between the front thereof and the recess in the forefoot area forms a support surface against which the toes of the foot may bear to provide a propulsive force during jumping.

* * * * *